US005368756A

United States Patent [19]

Vogel et al.

[11] Patent Number: 5,368,756

[45] Date of Patent: Nov. 29, 1994

[54] FABRIC SOFTENING COMPOSITIONS CONTAINING MIXTURES OF SOFTENER MATERIAL AND HIGHLY ETHOXYLATED CURD DISPERSANT

[75] Inventors: Alice M. Vogel; John C. Severns, both of West Chester; Errol H. Wahl, Cincinnati, all of Ohio

[73] Assignee: The Procter & Gamble Company, Cincinnati, Ohio

[21] Appl. No.: 106,325

[22] Filed: Aug. 13, 1993

Related U.S. Application Data

[63] Continuation of Ser. No. 851,606, Mar. 16, 1992, abandoned.

[51] Int. Cl.[5] ..... D06M 10/08; C11D 1/62

[52] U.S. Cl. ..... 252/8.8; 252/8.9; 252/547

[58] Field of Search ..... 252/8.8, 8.9, 547

[56] References Cited

U.S. PATENT DOCUMENTS

| | | | |
|---|---|---|---|
| 3,523,088 | 8/1970 | Dean et al. | 252/138 |
| 3,597,416 | 8/1971 | Diehl | 260/212 |
| 3,719,647 | 3/1973 | Hardy et al. | 260/86.1 R |
| 3,819,538 | 6/1974 | Little et al. | 252/174.21 |
| 3,929,678 | 12/1975 | Laughlin | 252/526 |
| 4,137,180 | 1/1979 | Naik et al. | 252/8.8 |
| 4,228,044 | 10/1980 | Cambre | 252/547 |
| 4,320,033 | 3/1982 | Yoshikawa | 252/174 |
| 4,597,898 | 7/1986 | Vander Meer | 252/529 |
| 4,724,089 | 2/1988 | Konig et al. | 252/8.8 |
| 4,789,491 | 12/1988 | Chang et al. | 252/8.75 |
| 4,806,255 | 2/1989 | Konig et al. | 252/8.8 |
| 4,808,321 | 2/1989 | Walley | 252/8.8 |
| 4,849,257 | 7/1989 | Borcher et al. | 252/8.7 |
| 4,906,413 | 3/1990 | Töpfl et al. | 252/8.8 |
| 4,931,216 | 6/1990 | Igarashi et al. | 252/8.8 |
| 4,986,936 | 1/1991 | Wolbers | 252/174.24 |
| 5,114,600 | 5/1992 | Biggin et al. | 252/174.23 |

FOREIGN PATENT DOCUMENTS

| | | |
|---|---|---|
| 239910 | 10/1987 | European Pat. Off. . |
| 0409502A2 | 1/1991 | European Pat. Off. . |
| 0409503A2 | 1/1991 | European Pat. Off. . |
| 0409504A2 | 1/1991 | European Pat. Off. . |
| WO92/19714 | 11/1992 | WIPO . |

*Primary Examiner*—Anthony McFarlane
*Attorney, Agent, or Firm*—Betty J. Zea

[57] ABSTRACT

Rinse-added fabric softening compositions are provided comprising mixtures of a diester quaternary ammonium fabric softener material, a highly ethoxylated hydrophobic material as a scum dispersant, and a liquid carrier. This mixture prevents the formation of scum caused by the interaction of the diester quaternary ammonium fabric softener material with anionic detergent surfactant and/or detergency builder entrapped in the fabric. These, preferably biodegradable, compositions have good product stability, dispersibility, and concentratability, as well as excellent fabric softening characteristics.

8 Claims, No Drawings

FABRIC SOFTENING COMPOSITIONS CONTAINING MIXTURES OF SOFTENER MATERIAL AND HIGHLY ETHOXYLATED CURD DISPERSANT

This is a continuation of application Ser. No. 07/851,606, filed on Mar. 16, 1992, now abandoned.

TECHNICAL FIELD

The present invention relates to textile treatment compositions. In particular, it relates to textile treatment compositions for use in the rinse cycle of a textile laundering operation to provide fabric softening/static control benefits. The compositions are characterized by excellent softening performance and, preferably, biodegradability.

BACKGROUND OF THE INVENTION

Textile treatment compositions suitable for providing fabric softening and static control benefits during laundering are well-known in the art and have found wide-scale commercial application. Conventionally, rinse-added fabric softening compositions contain, as the active softening component, substantially water-insoluble cationic materials having two long alkyl chains. Typical of such materials are ditallow alkyl dimethyl ammonium chloride and imidazolinium compounds substituted with two stearyl or tallow alkyl groups. These materials are normally prepared in the form of a dispersion in water.

It is highly desirable to prepare physically-acceptable textile treatment compositions containing biodegradable, water-insoluble, softener materials that exhibit excellent softening performance. However, materials which are biodegradable are often difficult to formulate as stable liquid compositions, especially at high concentrations.

The use of various quaternized ester-ammonium salts as cationic fabric softening agents is known in the art. For example, U.S. Pat. No. 4,339,391, Hoffmann et al., issued Jul. 13, 1982, lists a series of quaternized ester-ammonium salts which function as fabric softeners. Various quaternized ester-ammonium salts are commercially available under the trade names SYNPROLAM FS from ICI and REWOQUAT from REWO.

In addition, diester quaternary ammonium salts as fabric softeners are known in the art. For example, U.S. Pat. No. 4,137,180, Naik et al., issued on Jan. 30, 1979, relates to diester quaternary ammonium salts free of or containing less that 5% of monoester quaternary ammonium salts as a fabric softening compound.

E.P.A. No. 409,502, Tandela et al., published Jan. 23, 1991, discloses fabric softening compositions comprising biodegradable diester quaternary ammonium compounds and fatty acids which are added to boost the softener performance.

E.P.A. No. 409,503, Tandela, published Jan. 23, 1991, relates to biodegradable fabric softener compositions with an amine softener, fatty acid, and preferably a buffer acid. Anti-redeposition agents are optional. The reference teaches that the amine should be protonated to reduce the unwanted effects of anionic actives carried over from the main wash. The amine and buffer acid have a molar ratio of 5:1 to 1:10, preferably from 1:1 to 1:10. Preferred formulations may also contain fatty ethoxylated materials as performance boosters.

E.P.A. No. 409,504, Singh et al., published Jan. 23, 1991, relates to a biodegradable fabric softening composition comprising a diester quaternary ammonium material and an extender to minimize unacceptable thickening upon standing. The extender can be monoesters of polyethylene glycol of molecular weight between 200 and 2000. Anti-redeposition agents at up to 5% by weight are optional.

Similarly, methods for preparing various quaternized esteramine compounds are known in the art. See, for example, U.S. Pat. No. 3,342,840, Sobolev, issued Sep. 19, 1967, U.S. Pat. No. 3,872,138, Ogatu, issued March 18, 1975, and Japanese Laid Open Publication 49-1510, assigned to Gosei Chem. Ind. Co., published Jan. 9, 1974.

Various solutions to the problem of preparing concentrated fabric softening compositions suitable for consumer use have been addressed in the art. See, for example, U.S. Pat. Nos. 4,426,299, issued Jan. 17, 1984, and 4,401,578, issued Aug. 30, 1983, Verbruggen, which relate to paraffin, fatty acids and ester extenders in softener concentrates as viscosity control agents.

European Pat. No. 0,018,039, Clint et al., issued Mar. 7, 1984, relates to hydrocarbons plus soluble cationic or nonionic surfactants in softener concentrates to improve viscosity and stability characteristics.

U.S. Pat. No. 4,454,049, MacGilp et al., issued Jun. 12, 1984, discloses concentrated liquid textile treatment compositions in the form of isotropic solutions comprising water-insoluble di-$C_{16}$–$C_{24}$ optionally hydroxy-substituted alkyl, alkaryl or alkenyl cationic fabric softeners, at least about 70% of the fabric softener consisting of one or more components together having a melting completion temperature of less than about 20° C., a water-insoluble nonionic extender, especially $C_{10}$–$C_{40}$ hydrocarbons or esters of mono- or polyhydric alcohols with $C_8$–$C_{24}$ fatty acids, and a water-miscible organic solvent. The concentrates have improved formulation stability and dispersibility, combined with excellent fabric softening characteristics.

U.S. Pat. No. 4,439,330, Ooms, issued Mar. 27, 1984, teaches concentrated fabric softeners comprising ethoxylated amines.

U.S. Pat. No. 4,476,031, Ooms, issued Oct. 9, 1984, teaches ethoxylated amines or protonated derivatives thereof, in combination with ammonium, imidazolinium, and like materials.

The use of alkoxylated amines, as a class, in softener compositions is known (see, for example, German Patent Applications 2,829,022, Jakobi and Schmadel, published Jan. 10, 1980, and 1,619,043, Mueller et al., published Oct. 30, 1969, and U.S. Pat. Nos. 4,076,632, Davis, issued Feb. 28, 1978, and 4,157,307, Jaeger et al., issued June 5, 1979).

U.S. Pat. No. 4,422,949, Ooms, issued Dec. 27, 1983, relates to softener concentrates based on ditallow dimethyl ammonium chloride (DTDHAC), glycerol monostearate and polycationics.

In United Kingdom Application 2,007,734A, Sherman et al., published May 23, 1979, fabric softener concentrates are disclosed which contain a mixture of fatty quaternary ammonium salts having at least one $C_8$–$C_{30}$ alkyl substituent and an oil or substantially water-insoluble compound having oily/fatty properties. The concentrates are said to be easily dispersed/emulsified in cold water to form fabric softening compositions.

Concentrated dispersions of softener material can be prepared as described United Kingdom Patent Specification 1,601,360, Goffinet, published Oct. 28, 1981, by incorporating certain nonionic adjunct softening materials therein.

As can be seen, the various solutions to the specific problem of preparing fabric softening compositions in concentrated form suitable for consumer use have not been entirely satisfactory. It is generally known (for example, in U.S. Pat. No. 3,681,241, Rudy, issued Aug. 1, 1972) that the presence of ionizable salts in softener compositions does help reduce viscosity.

Ethoxylated amines having clay soil removal and anti-redeposition properties, which are incorporated into detergent compositions, are known in the art. See, for example, U.S. Pat. No. 4,597,898, Vander Meet, issued Jul. 1, 1986; U.S. Pat. No. 3,929,678, Laughlin et al., issued Dec. 30, 1975 (detergent composition containing polyethoxy zwitterionic surfactants with detergent builders); U.S. Pat. No. 3,719,647, Hardy et al., issued Mar. 6, 1973 (copolymers of acrylic or mothacrylic acid with acrylic or mothacrylic acid-ethylene oxide condensates); U.S. Pat. No. 3,597,416, Diehl, issued Aug. 3, 1971 (cellulose and carboxymethylcellulose derivatives); U.S. Pat. No. 3,523,088, Dean et al., issued Aug. 4, 1970 (alkali metal carboxymethylcellulose and hydroxypropylcellulose); and U.S. Pat. No. 4,228,044, Cambre, issued Oct. 14, 1980 (detergent composition with nonionic alkyl polyethoxy surfactant, polyethoxy alkyl quaternary cationic surfactant and a fatty amide surfactant).

Copending U.S. patent application Ser. No. 07/693,493, Vogel, Watson, Wahl and Benvegnu, filed Apr. 30, 1991, teaches softening compositions containing imidazoline mixtures with ethoxylated materials as scum dispersants.

All of the above patents, patent applications, and publications are incorporated herein by reference.

It has now been discovered that fabric softener compositions containing certain diester quaternary ammonium fabric softener materials interact with anionic surfactants and detergency builders that are carried over into the rinse cycle to form surprisingly high levels of undesirable scum. This invention provides a way to avoid the formation of scum without compromising the, e.g., biodegradable benefits and/or good fabric softening performance of the diester quaternary ammonium materials.

It is a preferred object of this invention to provide an effective, storage-stable, biodegradable fabric softening composition in the form of a liquid concentrate. It is a further objective to provide a softener composition which reduces scum formation in the washer rinse cycle and resulting deposition on fabrics and washer drums.

SUMMARY OF THE INVENTION

The present invention provides a liquid, preferably biodegradable, fabric softening composition in the form of an aqueous dispersion comprising:

(a) from about 1% to about 40%, preferably from about 3% to about 30%, by weight of diester quaternary ammonium compound having the formula:

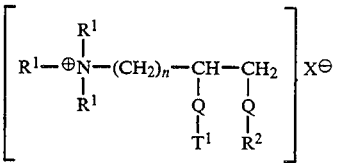

wherein, for any molecule:

each Q is

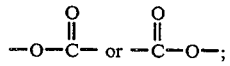

each $R^1$ is $C_1$–$C_4$ alkyl or hydroxy alkyl;

each $T^1$ and $T_2$ is a $C_{12}$–$C_{22}$ alkyl or alkenyl group;

n is an integer from 1 to 4; and $X^{\theta}$ is a softener-compatible anion; and wherein preferably $R^1$ is a methyl group, n is 1, Q is

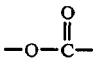

and $T^1$ and $T^2$ are $C_{14}$ to $C_{18}$.

(b) from about 0.2%, preferably 0.5%, to about 12% of a scum dispersant material containing at least about 17 ethoxy groups per molecule on the average to minimize the formation of scum by the interaction of (a) and anionic detergent surfactant and/or detergency builder, said scum dispersant material preferably being a highly ethoxylated hydrophobic material selected from the group consisting of:

(1) polyethoxylated fatty alcohols containing from about 12 to about 30 carbon atoms in the alcohol portion;

(2) polyethoxylated fatty acids containing from about 12 to about 30 carbon atoms in the fatty acid portion;

(3) polyethoxylated fatty amines containing from about 12 to about 30 carbon atoms with at least about 12 carbon atoms in one alkyl group;

(4) polyethoxylated fatty acid amides wherein said fatty acid contains from about 12 to about 30 carbon atoms;

(5) polyethoxylated quaternary ammonium compounds which contain from about 15 to about 30 carbon atoms with at least about 12 carbon atoms in one alkyl group;

2 (6) polyethoxylated amine oxides containing from about 14 to about 30 carbon atoms with at least about 12 carbon atoms in one alkyl group;

(7) polyethoxylate soil release polymers; and (8) mixtures thereof; and (c) from about 55% to about 98% of aqueous liquid carrier.

The preferred compositions of the present invention exhibit rapid biodegradability relative to compositions containing conventional fabric softening agents such as ditallow alkyl dimethyl ammonium chloride (DTDMAC). Also, the preferred compositions reduce scum formation in the washer rinse cycle and resulting deposit of scum on fabrics and washer drums.

The liquid compositions of the present invention are typically formulated at a neat pH of from about 1 to about 5, preferably at a pH of from about 2 to about 4, more preferably at a pH of from about 2.5 to about 4, to provide good storage stability.

Preferably, the fabric softener material (softening compounds) is dispersed in the liquid carrier as fine particles through high shear mixing.

Typically the particle size of the softener in the product should be less than one micron, preferably from about 0.1 to about 0.5 micron.

Water-dilutable fabric softener "concentrates" which contain from about 9% to about 40%, preferably from about 15% to about 30%, by weight of fabric softener active, can be conveniently packaged in containers, e.g., cartons or pouches, and can be diluted with water by the user to produce "single-strength" softeners (typically, 3–9% concentration of softener active).

All percentages, ratios and proportions herein are by weight, unless otherwise specified. All numbers are approximations unless otherwise stated.

DETAILED DESCRIPTION OF THE INVENTION

The compositions comprise a mixture of the fabric softener compounds (i.e., group (a) above), material (b) to minimize scum formation (scum dispersant), and (c) a liquid carrier. The weight ratio of the diester quaternary ammonium fabric softener material (a) to the scum dispersant (b) is preferably in the range of from about 80:1 to about 6:1, preferably from about 60:1 to about 9:1, more preferably from about 34:1 to about 12.1.

Biodegradable Diester Quaternary Ammonium Compound

The present invention contains as an essential component from about 1% to about 40% of diester quaternary ammonium fabric softener material, typically consisting essentially of a diester quaternary ammonium softening compound having the formula:

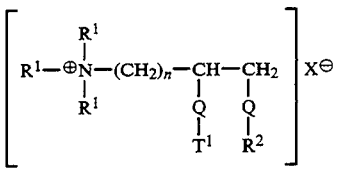

wherein, for any molecule:

each Q is

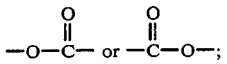

each $R^1$ is $C_1$–$C_4$ alkyl or hydroxy alkyl;

each $T^1$ and $T^2$ is a $C_{12}$–$C_{22}$ alkyl or alkenyl;

n is an integer from 1 to 4; and $X^{\theta}$ is a softener-compatible anion; and wherein preferably $R^1$ is a methyl group, n i s 1, and Q is

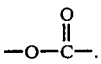

The straight or branched alkyl or alkenyl chains, $T^1$ and $T^2$, have from about 12 to about 22 carbon atoms, preferably from about 14 to about 18 carbon atoms, more preferably straight chains having from about 14 to about 18 carbon atoms.

Tallow is a convenient and inexpensive source of long chain alkyl and alkenyl materials.

A specific example of a biodegradable diester quaternary ammonium compound suitable for use in the aqueous fabric softening compositions herein include:

1,2-ditallowyl oxy-3-trimethyl ammoniopropane chloride.

Other examples of suitable diester quaternary ammoniums of this invention are obtained by, e.g., replacing "tallowyl" in the above compounds with, for example, cocoyl, palmoyl, lauryl, oleyl, stearyl, palmityl, or the like;

replacing "methyl" in the above compounds with ethyl, propyl, isopropyl, butyl, isobutyl, t-butyl, or the hydroxy substituted analogs of these radicals;

replacing "chloride" in the above compounds with bromide, methylsulfate, formate, sulfate, nitrate, and the like.

In fact, the anion is merely present as a counterion of the positively charged quaternary ammonium compound. The scope of this invention is not considered limited to any particular anion.

The compounds herein can be prepared by standard esterification and quaternization reactions, using readily available starting materials. General methods for preparation are disclosed in U.S. Pat. No. 4,137,180, incorporated hereinbefore by reference.

The biodegradable diester quaternary ammonium compounds herein are present at levels of from about 1% to about 40%, preferably from about 3% to about 30%, by weight of the composition. They can be used in aqueous fabric softening compositions to fully or partially replace conventional, less rapidly biodegradable fabric softening ingredients; therefore, the compositions of this invention optionally contain additional softening agents.

The Scum Dispersant Material

The scum dispersant materials herein are formed by highly ethoxylating hydrophobic materials. The hydrophobic material can be a fatty alcohol, fatty acid, fatty amine, fatty acid amide, amine oxide, quaternary ammonium compound, and/or the hydrophobic moieties used to form soil release polymers. The preferred materials are highly ethoxylated, e.g., more than about 17, preferably more than about 25, more preferably more than about 40, moles of ethylene oxide per molecule on the average, with the polyethylene oxide portion being from about 76% to about 97%, preferably from about 81% to about 94%, of the total molecular weight.

The preferred hydrophobic moiety is derived from a fatty alcohol containing from about 12 to about 22, preferably from about 14 to about 18, carbon atoms. Suitable fatty alcohols are those prepared by hydrogenating tallow and/or palm stearine fatty acids. Such fatty alcohol polyethoxylates, when they contain at least about 40 ethoxy moieties, provide scum dispersant properties. Typical materials include stearyl alcohol polyethoxylate (100) and hydrogenated tallow alcohol polyethoxylate (50) (i.e., Brij® 700 and Genapol® T-500 respectively).

Other hydrophobic moieties can be derived from fatty acids and/or fatty acid amides in which the fatty acids contain from about 12 to about 22, preferably from about 14 to about 18, carbon atoms. The amide can be a primary amide (preferable), or can be substituted with one or two alkyl, or hydroxyalkyl groups containing from one to about six carbon atoms. The amide must contain at least one reactive hydrogen atom to allow ethoxylation.

Other hydrophobic materials that can be ethoxylated include nitrogen-containing compounds such as amines, amine oxides, and/or quaternary ammonium compounds with a single long hydrophobic, preferably alkyl or alkenyl, most preferably alkyl, group having the same carbon content as the fatty alcohol and/or fatty acid groups described hereinbefore. The additional substituents on the nitrogen, if any, are alkyl, or hydroxyalkyl groups containing from one to about six, preferably from about one to about two, carbon atoms. As with the fatty acid amide, the nitrogen-containing compounds must contain at least one reactive hydrogen atom to allow ethoxylation to occur.

All of the above compounds are typically prepared with essentially the same length of alkyl hydrophobic group and essentially the same ethoxylation content. Generically, these scum dispersants are polyethoxylated hydrophobic materials containing at least one hydrophobic group containing at least about 12 carbon atoms, preferably alkyl (optionally including alkenyl), and at least about 17, preferably at least about 25, more preferably at least about 40, ethoxy units. The total carbon content in the hydrophobic portion is usually less than about 30 atoms, preferably less than about 20 atoms.

Another group of compounds that can be used as scum dispersants are also used as "soil release" materials. The soil release material must contain the same amount of ethoxylation as the other materials, but the hydrophobic portion is an oligomer unit, or units, which are hydrophobic and contain the same monomers used to form polyester, polyamide, etc., fibers. Such soil release materials are well-known and suitable materials are described in U.S. Pat. Nos.: 4,711,730, Gosselink and Diehl, issued Dec. 8, 1987; 4,749,596, Evans, Huntington, Stewart, Wolf, and Zimmerer, issued Jun. 7, 1988; 4,818,569, Trinh, Gosselink, and Rattinger, issued Apr. 4, 1989; 4,877,896, Maldonado, Trinh, and Gosselink, issued Oct. 31, 1989; 4,956,447, Gosselink et al., issued Sep. 11, 1990; and 4,976,879, Maldonado, Trinh, and Gosselink, issued Dec. 11, 1990, all of said patents being incorporated herein by reference.

A preferred soil release agent is a copolymer having blocks of terephthalate and polyethylene oxide. More specifically, these polymers are comprised of repeating units of ethylene terephthalate and polyethylene oxide terephthalate at a molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon® 4780 (from Dupont) and Milease® T (from ICI).

Highly preferred soil release agents are polymers of the generic formula:

$$R—[O—D^2—O—C(O)—D^1—C(O)—]_xO—(CH_2CH_2O)_n—[C(O)—D^1—C(O)—O—D^2—O]_y—R$$

wherein $D^1$ is a phenylene group; $D^2$ is a $—CH_2CH(CH_3)—$ group; each R is selected from the group consisting of H and $—C(O)D^1—SO_3M$ where M is a compatible cation, typically H; n is selected for water solubility and each n is generally from about 20 to about 150, preferably from about 50 to about 100; and the sum of x and y, which is critical to formulation in a liquid composition having a relatively high ionic strength, being from about 6 to about 12, with preferably x and y being less than about 10.

The $D^1$ moieties are essentially 1,4-phenylene moieties. As used herein, the term "the $D^1$ moieties are essentially 1,4-phenylene moieties" refers to compounds where the $D^1$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4-phenylene include 1,3-phenylene, 1,2-phenylene, 1,8-naphthylene, 1,4-naphthylene, 2,2-biphenylene, 4,4-biphenylene and mixtures thereof. Alkylene and alkenylene moieties which can be partially substituted include ethylene, 1,2-propylene, 1,4-butylene, 1,5-pentylene, 1,6-hexamethylene, 1,7-heptamethylene, 1,8-octamethylene, 1,4-cyclohexylene, and mixtures thereof.

For the $D^1$ moieties, the degree of partial substitution with moieties other than 1,4-phenylene should be such that the soil release properties of the compound are not adversely affected to any great extent. Generally, the degree of partial substitution which can be tolerated will depend upon the backbone length of the compound, i.e., longer backbones can have greater partial substitution for 1,4-phenylene moieties. Usually, compounds where the $D^1$ comprise from about 50% to about 100% 1,4-phenylene moieties (from 0 to about 50% moieties other than 1,4-phenylene) have adequate soil release activity. For example, polyesters made according to the present invention with a 40:60 mole ratio of isophthalic (1,3-phenylene) to terephthalic (1,4-phenylene) acid have adequate soil release activity. However, because most polyesters used in fiber making comprise ethylene terephthalate units, it is usually desirable to minimize the degree of partial substitution with moieties other than 1,4-phenylene for best soil release activity. Preferably, the $D^1$ moieties consist entirely of (i.e., comprise 100%) 1,4-phenylene moieties, i.e., each $D^1$ moiety is 1,4-phenylene.

For the $D^2$ moieties, suitable ethylene or substituted ethylene moieties include: ethylene; 1,2-propylene; 1,2-butylene; 1,2-hexylene; 3-methoxy-1,2-propylene; and mixtures thereof. Preferably, the $D^2$ moieties are essentially ethylene moieties, 1,2-propylene moieties or mixtures thereof. Inclusion of a greater percentage of ethylene moieties tends to improve the soil release activity of compounds. Surprisingly, inclusion of a greater percentage of 1,2-propylene moieties tends to improve the water solubility of the compounds.

Therefore, the use of 1,2-propylene moieties or a similar branched equivalent is desirable for incorporation of any substantial part of the soil release component in the liquid fabric softener compositions. Preferably, from about 75% to about 100%, more preferably from about 90% to about 100%, of the $D^2$ moieties are 1,2-propylene moieties.

The value for each n is at least about 6, and preferably is at least about 10. The value for each n usually ranges from about 12 to about 113. Typically, the value for each n is in the range of from about 12 to about 43.

The level of scum dispersant is sufficient to keep the scum at an acceptable, preferably unnoticeable (to the consumer), level under the conditions of use. Depending upon the amount of anionic or nonionic detergent, etc., used in the wash cycle of a typical laundering process, the efficiency of the rinsing steps prior to the introduction of the compositions herein, and the water hardness, the amount of anionic detergent surfactant and/or detergency builder (especially phosphates) entrapped in the fabric (laundry) will vary. For scum dispersant purposes, the minimum amount of scum dispersant should be used. Typically this is at least about 2%, preferably at least about 4%, based upon the level of the diester quaternary ammonium fabric softener material. It is also desirable to minimize the amount of anti-scum agent so as to avoid negatively impacting the softening performance of the actives. At levels of about 10% (relative to the softener material) or more, one risks loss of softening efficacy of the product especially when the fabrics contain high proportions of nonionic surfactant which has been adsorbed during the washing operation. When the ratio of softener to scum dispersant is maintained within the weight ratio ranges set forth hereinbefore, softening is normally acceptable.

Preferred scum dispersants are: Brij® 700; Varonic® U-250; Genapol® T-500; Genapol® T-800; Plurafac® A-39; and Neodol® 25-50.

Liquid Carrier

The compositions herein comprise a liquid carrier, e.g., water. These compositions comprise from about 55% to about 98%, preferably from about 70% to about 95% of the liquid carrier.

The diester quaternary ammonium softening compounds used in this invention are insoluble in such water-based carriers and, thus, are present as a dispersion of fine particles therein. These particles are conveniently prepared by high-shear mixing which disperses the compounds as fine particles. Again, since the preferred ester softening compounds are hydrolyrically labile, care should be taken to avoid the presence of base with such compounds, and to keep the processing temperatures and pH within the ranges specified herein.

Optional Ingredients

Fully-formulated fabric softening compositions can optionally contain, in addition to the biodegradable, diester quaternary ammonium softening compounds of the formulas herein, scum reducing agent and liquid carrier, one or more of the following ingredients.

Silicone Component

The fabric softening compositions herein optionally contain an aqueous emulsion of a predominantly linear polydialkyl or alkyl aryl siloxane in which the alkyl groups can have from one to five carbon atoms and can be wholly, or partially, fluoridated. These siloxanes act to provide improved fabric benefits. Suitable silicones are polydimethyl siloxanes having a viscosity, at 25° C., of from about 1 to about 100,000 centistokes, preferably from about 1,000 to about 12,000 centistokes. For certain applications, e.g., concentrated formulas, siloxanes with a viscosity of as low as 1 centistoke are preferred.

The fabric softening compositions herein can contain up to about 15%, preferably from about 0.1% to about 10%, of the silicone component.

Thickening Agent

Optionally, the compositions herein contain from 0% to about 3%, preferably from about 0.01% to about 2%, of a thickening agent. Examples of suitable thickening agents include: cellulose derivatives, synthetic high molecular weight polymers (e.g., carboxyvinyl polymer and polyvinyl alcohol), and cationic guar gums.

The cellulosic derivatives that are functional as thickening agents herein can be characterized as certain hydroxyethers of cellulose, such as Methocel®, marketed by Dow Chemicals, Inc.; also, certain cationic cellulose ether derivatives, such as Polymer JR-125®, JR-400®, and JR-30M®, marketed by Union Carbide.

Other effective thickening agents are cationic guar gums, such as Jaguar Plus®, marketed by Stein Hall, and Gendrive® 458, marketed by General Mills.

Preferred thickening agents herein are selected from the group consisting of methyl cellulose, hydroxypropyl methylcellulose, hydroxybutyl methylcellulose, or mixtures thereof, said cellulosic polymer having a viscosity in 2% aqueous solution at 20° C. of from about 15 to about 75,000 centipoises.

Viscosity Control Agents

Viscosity control agents can be used in the compositions of the present invention (preferably in concentrated compositions). Examples of organic vicosity modifiers are fatty acids and esters, fatty alcohols, and water-miscible solvents such as short chain alcohols. Examples of inorganic viscosity control agents are water-soluble ionizable salts. A wide variety of ionizable salts can be used. Examples of suitable salts include sodium citrate and the halides of the group IA and IIA metals of the Periodic Table of the Elements, e.g., calcium chloride, magnesium chloride, sodium chloride, potassium bromide and lithium chloride. Calcium chloride is preferred. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator.

In addition to their role as viscosity agents, the ionizable salts mentioned above also function as electrolytes and can further improve the stability of the compositions herein. A highly preferred electrolyte is calcium chloride.

Typical electrolyte levels are from about 20 to about 15,000 parts per million (ppm), preferably from about 20 to about 10,000 ppm by weight of the compositions. Maximum electrolyte levels of 6,000 ppm and 4,000 ppm are desirable for some compositions.

Bactericides

Examples of bactericides used in the compositions of this invention include glutaraldehyde, formaldehyde, 2-bromo-2-nitropropane-1,3-diol sold by Inolex Chemicals, located in Philadelphia, Pennsylvania, under the trade name Bronopol®, and a mixture of 5-chloro-2-methyl-4-isothiazoline-3-one and 2-methyl-4-isothiazoline-3-one sold by Rohm and Haas Company under the trade name Kathon ® CG/ICP. Typical levels of bactericides used in the present compositions are from about 1 to about 1,000 ppm by weight of the composition.

Other Optional Ingredients

The present invention can include other optional components conventionally used in textile treatment compositions, for example, colorants, perfumes, preservatives, optical brighteners, opacifiers, surfactants, stabilizers such as guar gum and polyethylene glycol, anti-shrinkage agents, anti-wrinkle agents, fabric crisping agents, spotting agents, germicides, fungicides, anti-oxidants such as butylated hydroxy toluene, anti-corrosion agents, and the like.

In the method aspect of this invention, fabrics or fibers are contacted with an effective amount, generally from about 20 ml to about 300 ml (per 3.5 kg of fiber or fabric being treated), of the compositions herein in an aqueous bath. Of course, the amount used is based upon the judgment of the user, depending on concentration of the composition, fiber or fabric type, degree of softness desired, and the like. Typically, from about 20 to about 300 ml. of an 8% to 30% dispersion of the softening compounds are used in a 25 gallon laundry rinse bath to soften and provide antistatic benefits to a 3.5 kg load of mixed fabrics. Preferably, the rinse bath contains from about 200 ppm to about 1,000 ppm of the fabric softening compositions herein.

The following examples illustrate the practice of the present invention but are not intended to be limiting thereof.

TABLE 1

| Example: Component | I Wt. % | II Wt. % | III Wt. % | IV Wt. % |
|---|---|---|---|---|
| Quaternary Softener | | | | |
| Raw Material | 7.10 | 6.43 | 10.00 | 6.80 |
| Diester[1] | 5.00 | 4.50 | 7.00 | 4.76 |
| Monoester[2] | 0.71 | 0.64 | 1.00 | 0.68 |
| Ethanol | 0.79 | 0.71 | 1.10 | 0.75 |
| Genapol T-500 (Anti-Scum) | 0.20 | 0.40 | 0.60 | 0.40 |
| Ethanol | 3.65 | — | — | — |
| DI $H_2O$ | 89.05 | 93.17 | 86.40 | 82.51 |
| PEG-400 Monostearate | — | — | 3.00 | — |
| Neodol 45-13[3] | — | — | — | 1.09 |
| Lanolin | — | — | — | 6.20 |
| Glycerol Monostearate | — | — | — | 3.00 |

| Example: Component | V Wt. % | VI Wt. % | VII Wt. % | VIII Wt. % |
|---|---|---|---|---|
| Quaternary Softener | | | | |
| Raw Material | 6.80 | 10.00 | 6.43 | 7.10 |
| Diester[1] | 4.76 | 7.00 | 4.50 | 5.00 |
| Monoester[2] | 0.68 | 1.00 | 0.64 | 0.71 |
| Ethanol | 0.75 | 1.10 | 0.71 | 0.79 |
| Ethanol | — | — | — | 5.00 |
| DI $H_2O$ | 82.91 | 87.00 | 93.57 | 87.90 |
| PEG-400 Monostearate | — | 3.00 | — | — |
| Neodol 45-13[3] | 1.09 | — | — | — |
| Lanolin | 6.20 | — | — | — |
| Glycerol Monostearate | 3.00 | — | — | — |

[1]DTTMAPC (1,2-ditallow oxy trimethyl ammonium propane chloride) in Examples II, III, IV, V, VI, VII.
[2]THTMPAC (1-tallow oxy 2-hydroxy trimethyl ammonium propane chloride) in Examples II, IV, V, VII.
[3]$C_{14}$–$C_{15}$ alcohol ethoxylate with 13 moles of ethylene oxide.

TABLE 2

Washer Stress Test Results
(Detergent with Anionic Surfactant and/or Detergency Builder)

| Example | No Scum | Scum | Serious Scum |
|---|---|---|---|
| I | Very little scum in performance test | | |
| II | 14 | 1 | 0 |
| III | 12 | 3 | 0 |
| IV | 8 | 7 | 2 |
| V | 2 | 13 | 7 |
| VI | 5 | 10 | 4 |
| VII | 4 | 11 | 6 |
| VIII | Large amount of scum in performance test | | |

Scum noticeability is measured as the total number of navy/black fabrics exhibiting visual incidents of scum, and the number of incidents which are visually serious. The noticeability limit, established as being consumer acceptable, is no more than 4 total incidents, of which 2 are serious. To test scum noticeability, a typical large laundry load consisting of 15 navy/black articles is washed in warm (−95° F.) (−35° C.) water with the recommended dose of detergent. At the beginning of the rinse cycle, a recommended dose of softener is added to the water (water at −62° F.) (−17° C.). After the final spin cycle is complete, each laundered item is graded visually for scum incidences and seriousness. An incident of scum is considered serious if the fabric has one or more "spots" of scum whose area is greater than −2 $cm^2$, or if more than 10; of fabric's surface area is covered by smaller (but noticeable) "spots."

What is claimed is:

1. Liquid fabric softening composition in the form of an aqueous dispersion comprising:

(a) from about 1% to about 40% of diester quaternary ammonium fabric softener material of the formula:

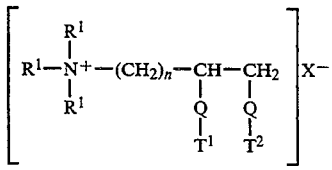

wherein, for each molecule:

each Q is

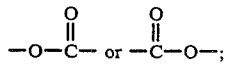

each $R^1$ is a $C_1$–$C_4$ alkyl or hydroxy alkyl group;

each $T^1$ and $T^2$ is a $C_{12}$–$C_{22}$ alkyl or alkenyl group;

n is an integer from 1 to 4; and $X^-$ is a softener-compatible anion;

(b) from about 0.2% to about 12% of scum dispersant material which is highly ethoxylated hydrophobic material that minimizes the formation of scum by the interaction of (a) and any anionic detergent surfactant or detergency builder in the rinse water; and (c) from about 55% to about 98% of aqueous liquid carrier;

wherein said scum dispersant material contains at least about 25 ethoxy groups per molecule; wherein said scum dispersant material is selected from the group consisting of:

(1) polyethoxylated fatty alcohols containing from about 12 to about 30 carbon atoms in the alcohol portion;

(2) polyethoxylated fatty acids containing from about 12 to about 30 carbon atoms in the fatty acid portion;

(3) polyethoxylated fatty amines containing from about 12 to about 30 carbon atoms with at least about 12 carbon atoms in one alkyl group; p1 (4) polyethoxylated fatty acid amides wherein said fatty acid contains from about 12 to about 30 carbon atoms;

(5) polyethoxylated quaternary ammonium compounds which contain from about 15 to about 30 carbon atoms with at least about 12 carbon atoms in one alkyl group;

(6) polyethoxylated amine oxides containing from about 14 to about 30 carbon atoms with at least about 12 carbon atoms in one alkyl group; and (7) mixtures thereof;

and wherein the weight ratio of the diester quaternary ammonium fabric softener material (a) to the scum dispersant (b) is from about 80:1 to about 6:1.

2. The composition of claim 1 wherein said scum dispersant material contains at least about 40 ethoxy groups per molecule on the average.

3. The composition of claim 1 wherein said scum dispersant material is polyethoxylated fatty alcohol (1) or fatty acid (2).

4. The composition of claim 1 wherein said diester quaternary ammonium fabric softener material has the formula:

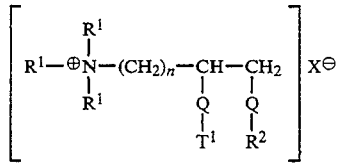

wherein:

Q is

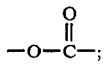

$T^1$ and $T^2$ have from about 14 to about 18 carbon atoms;

and n is an 1.

5. The composition of claim 4 wherein the said diester quaternary ammonium fabric softener has a concentration of from about 3% to about 30%.

6. The composition of claim 4 wherein said scum dispersant material contains at least about 40 ethoxy groups per molecule on the average.

7. The composition of claim 4 wherein said scum dispersant material is polyethoxylated fatty alcohol (1) or fatty acid (2).

8. The process of preparing the composition of claim 1 wherein said diester quaternary ammonium fabric softener material and said scum dispersant material are homogeneously mixed as a melt before being added to said aqueous liquid carrier.

* * * * *